United States Patent [19]

Weidler

[11] 4,354,719

[45] Oct. 19, 1982

[54] TWO-ROW ELECTRICAL CONNECTOR COMPOSED OF CONNECTOR MODULES

[75] Inventor: Charles H. Weidler, Lancaster, Pa.

[73] Assignee: AMP Incorporated, Harrisburg, Pa.

[21] Appl. No.: 189,532

[22] Filed: Sep. 22, 1980

[51] Int. Cl.[3] ..... H01R 11/20; H01R 33/76

[52] U.S. Cl. ..... 339/59 M; 339/99 R; 339/208

[58] Field of Search ..... 339/59 R, 59 M, 63 R, 339/63 M, 97 P, 98, 99 R, 206 R, 206 P, 207, 208

[56] References Cited

U.S. PATENT DOCUMENTS

| | | | |
|---|---|---|---|
| 3,233,206 | 2/1966 | Faila | 339/98 |
| 3,506,949 | 4/1970 | Venaleck et al. | 339/174 |
| 3,727,174 | 4/1973 | Podmore et al. | 339/210 M |
| 3,950,063 | 4/1976 | Johansson | 339/97 |
| 4,040,703 | 8/1977 | Shaffer et al. | 339/99 R |
| 4,066,321 | 1/1978 | Villazon | 339/98 |
| 4,202,595 | 5/1980 | Inouye et al. | 339/174 |

*Primary Examiner*—Neil Abrams

*Attorney, Agent, or Firm*—Frederick W. Raring

[57] ABSTRACT

Two row electrical connector comprises a pair of connector housing modules which are hinged to each other and which are folded so that their base portions are against each other. Each module contains a single row of terminal receiving cavities in which terminals are contained. The two modules are in turn contained in a pair of cover members which form an external housing shell for the modules. Improved methods of connecting wires to two row connectors and thereafter assembling the parts of the connector are also disclosed.

8 Claims, 4 Drawing Figures

TWO-ROW ELECTRICAL CONNECTOR COMPOSED OF CONNECTOR MODULES

FIELD OF THE INVENTION

This invention relates to electrical connectors of the type having a plurality of electrical terminals therein which are arranged in two parallel rows and which have wires connected to the terminals and extending from a wire entry face of the connector.

BACKGROUND OF THE INVENTION

It is widespread practice in many branches of the electrical industry to disengageably connect groups or bundles of wires to each other by providing multi-contact electrical connectors on the ends of the wires of the bundles. Each connector contains a plurality of contact terminals and each wire is connected to one of the terminals. The wires can thus be connected to each other by merely mating the two connectors with each other.

A variety of types of connectors, as regards the arrangement of the terminals in the connector and the means of connecting the wires to the terminals, are being used. The wires may be soldered to the terminals in the connector housing or electrical terminals can be crimped onto the ends of the wires and the terminals thereafter inserted into cavities in the connector housing. Connectors of these two types have long been used and more recently, a type of connector has been introduced which has therein terminals of a type having wire receiving slots so that the wires can be connected to the terminals by merely moving the wires laterally of their axes and into the slots. The introduction of wire-in-slot type terminals has resulted in greatly improved methods of assembling multi-contact electrical connectors to wires and has resulted in the achievement of substantial economies in the industry. For example, U.S. Pat. No. 4,043,017 shows a machine which is capable of positioning wires in alignment with terminals in a connector and simultaneously inserting the wires into the terminals in the connector. In each operating cycle of this type of assembly machine then, a harness subassembly is produced consisting of a connector having wires extending from each of its terminals. Another benefit which has been realized from the introduction of wire-in-slot type terminals in disclosed in U.S. Pat. No. 3,859,724 which teaches a method of producing electrical harnesses by simply positioning the connectors as required on a harness board, lacing wires over the harness board in accordance with the wiring plan of the harness, and inserting the wires into the terminals in the connectors on the harness board. This manufacturing method has substantially shortened the amount of time required to produce a harness and has greatly reduced the amount of labor required in harness manufacturing operations.

The assembly machine disclosed on the above identified U.S. Pat. No. 4,043,017 and the harness manufacturing method taught in U.S. Pat. No. 3,859,724 can be practiced only with single row electrical connectors, that is, electrical connectors in which all of the terminals are arranged in a single row in side-by-side relationship. While widespread use is made of single row electrical connectors, there is also a substantial need for two row electrical connectors, that is, connectors which have two rows of contact terminals therein, the rows being side-by-side and parallel to each other.

The present invention is directed to the achievement of an improved two row electrical connector which, in its own right, is economical to manufacture and install on the ends of wires. The invention is also directed to the achievement of a two row electrical connector which can be installed on the ends of wires by means of automatic or semiautomatic machines of the type described in the above identified U.S. Pat. No. 4,043,017 and which can also be used in the manufacture of electrical harnesses as disclosed in U.S. Pat. No. 3,859,724. The invention is further directed to the achievement of improved assembly methods for producing two row multi-contact electrical connectors.

A preferred form of connector in accordance with the invention comprises a pair of connector housing modules which are substantially similar to each other and each of which has a plurality of contact receiving cavities therein, the cavities in each module being arranged in a single row. The modules are hinged to each other in side-by-side relationship by a hinge means which permits the modules to be folded towards each other in the manner of closing an open book, so that the base portions of the modules are against each other to form a housing of a two row connector. The modules have interengageable latching means thereon so that when they are so folded, they will become latched to each other and will be retained in their assembled condition. The terminals in the modules are of the type which are connected to wires by movement of the wires into wire receiving slots in the terminals. The terminals are so arranged in the housing modules that the pair of modules of a connector can be processed in known types of assembling machines to have the wires connected to the terminals while the modules are in side-by-side relationship. After connection of the wires to the terminals, the modules are folded to produce the finished connector. It is desirable to provide, in some instances, separate cover members which can be assembled to the connector modules and which completely enclose the modules.

PRACTICE OF THE INVENTION

Figure 3:
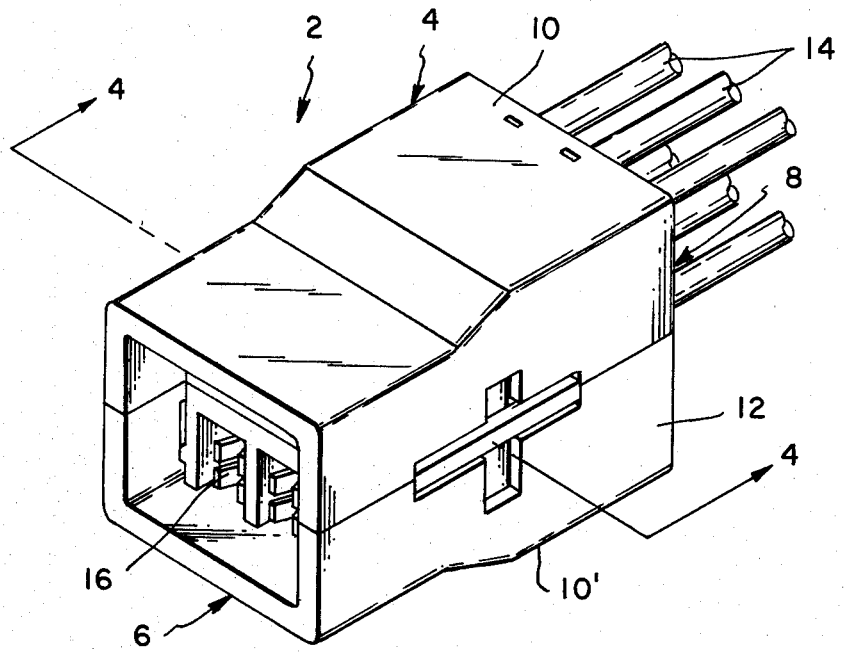
FIG. 3 is a perspective view of a fully assembled connector in accordance with the invention.

A connector assembly 2, FIG. 3, in accordance with the invention, comprises a housing assembly 4 having a mating face 6, a wire entry face 8 upwardly and downwardly facing (as viewed in drawing) sidewalls 10, 10' and laterally facing endwalls 12, 12'. Wires 14 extend into the housing assembly at the wire entry face 8 and are connected to terminals 16 which are contained in the housing, as will be described below.

Structural details of the connector assembly can best be understood from a description of the component parts of the assembly and the manner in which wires are connected to the terminals in the assembly and the parts of the assembly brought together to produce the finished connector.

Figure 1:
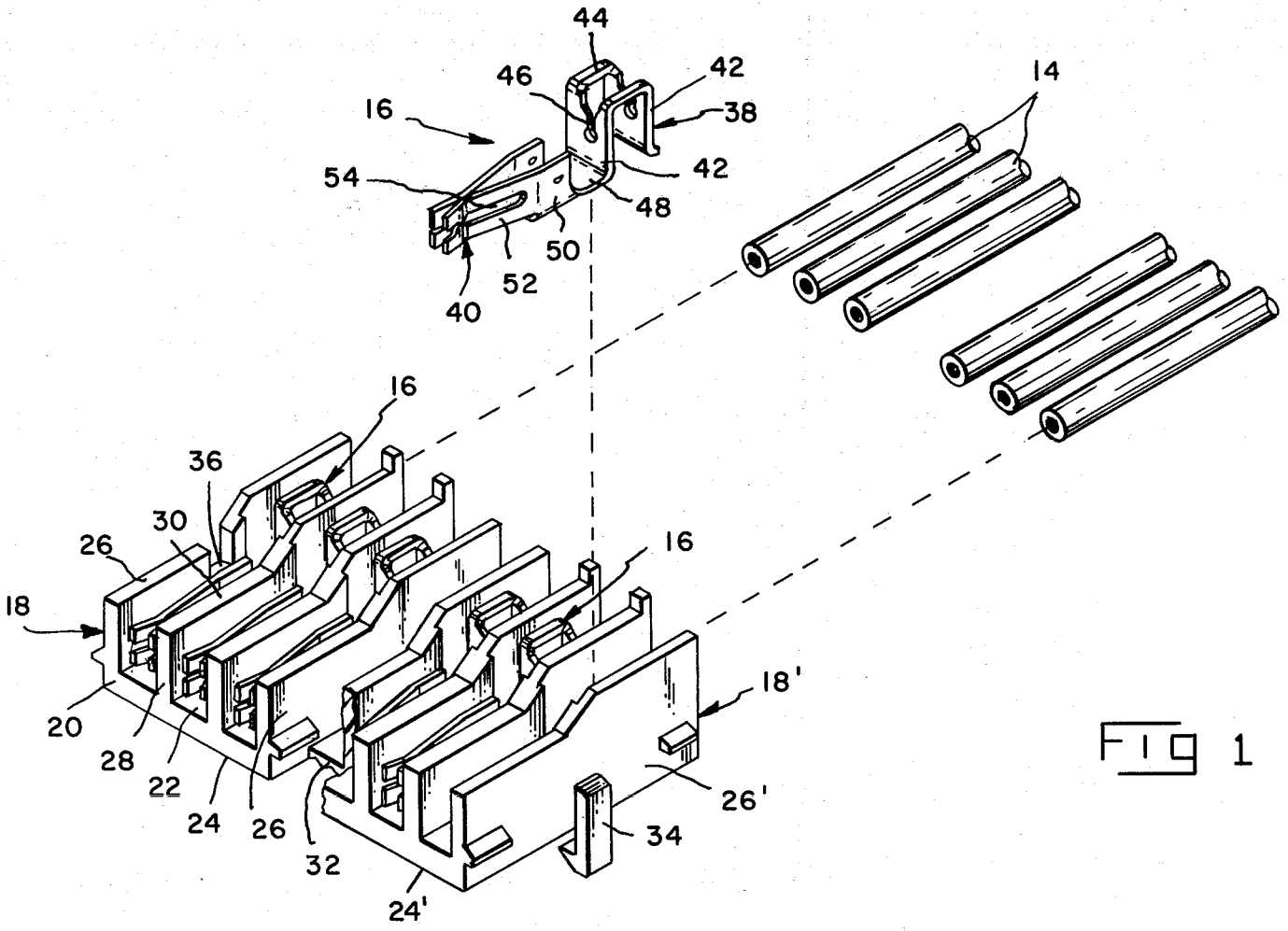
FIG. 1 is a perspective view showing a pair of connector modules in accordance with the invention, wires aligned with the terminals in the modules, and showing one of the terminals exploded from its module.
Figure 2:
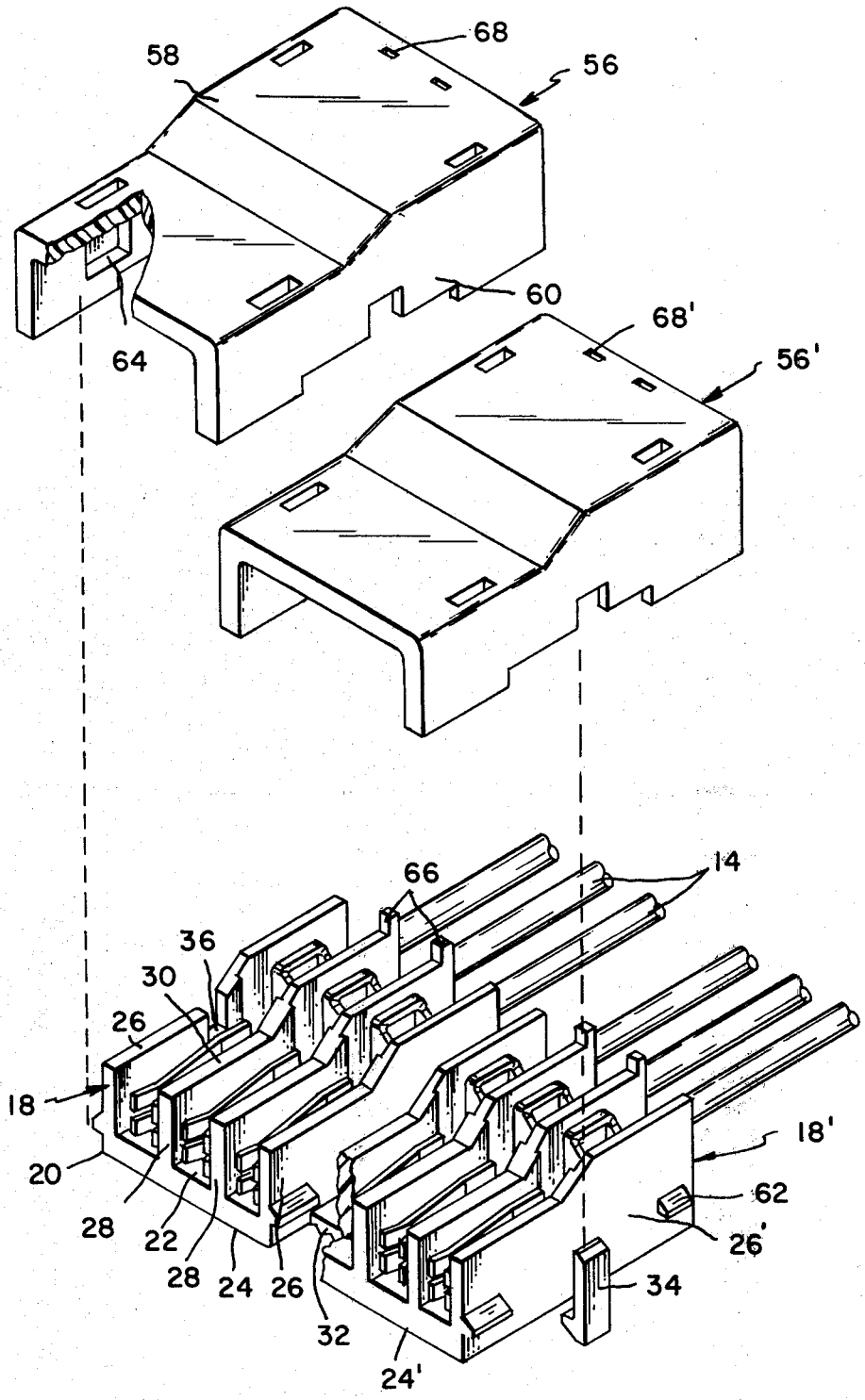
FIG. 2 is a view similar to FIG. 1 showing the wires connected to the terminals and showing cover members in alignment with the modules in preparation for assembly of the covers to the modules.

As shown best in FIG. 1, the connector assembly comprises a pair of similar connector housing modules 18, 18' which are in side-by-side relationship and which are connected to each other by hinge means 32. Since the modules are similar, the same reference numerals, differentiated by prime marks, will be used to identify corresponding parts of the two modules and only the module 18 will be described in detail.

The module 18 is a molded thermoplastic material and comprises a continuous planar generally rectangular barrier wall portion 20 having upwardly and downwardly facing major surfaces 22, 24. Endwall portions 26 extend upwardly from the end edges of the wall portion 20 above the surface 22 and separate cavity walls 28 extend from the surface 22 between the endwall portions 26. Thwe endwall portions and the cavity walls define spaced-apart cavities, each of which contains one of the contact terminals 16. The upper ends of the endwall portions 26 and the cavity walls constitute a module sidewall 30 which is interrupted by the cavities which extend inwardly through this sidewall.

Figure 4:
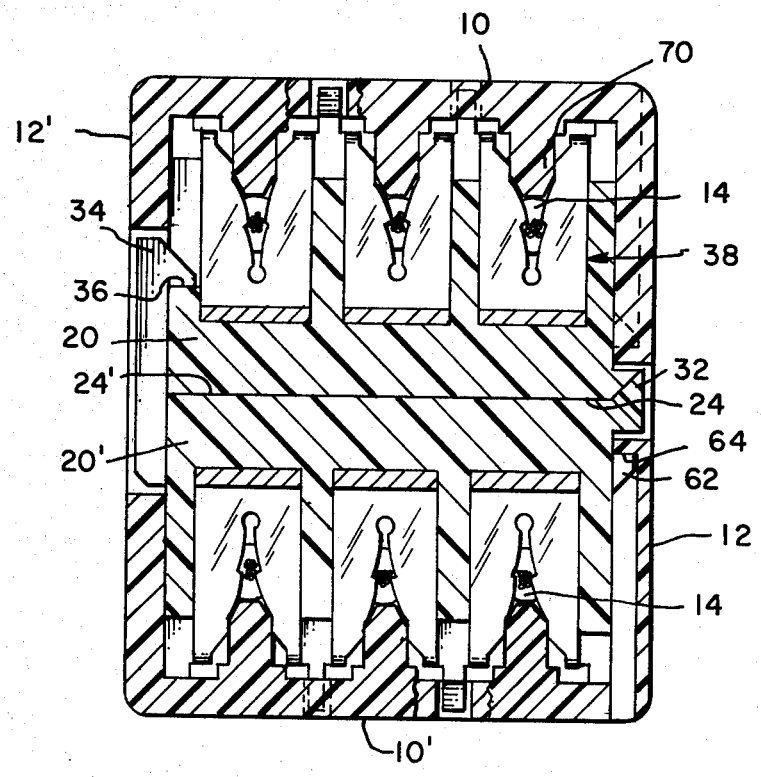
FIG. 4 is a cross-sectional view taken along the lines 4—4 of FIG. 3.

The hinge means 32 is constructed such that the two modules 18, 18' can be folded towards each other until the surfaces 24, 24' are against each other thereby to form the housing for a two row electrical connector, as shown in FIG. 4. In order to retain the two modules against each other, the module 18' is provided with a latch arm 34 extending from one of its endwall portions and the corresponding endwall portion of the module 18 is provided with a notch 36 which receives the hook-like end of the arm 34.

The individual terminals 16 are stamped and formed sheet metal and have a wire connecting portion 38 and a contact portion 40. The wire connecting portion 38 comprises a pair of parallel plate sections 42 connected at their ends by spaced-apart integral strips 44. These plate sections have wire receiving slots 46 so that a wire can be connected to each terminal by moving the wire laterally of its axis and into the slots 46 of the plate members.

The contact section 40 comprises a pair of spring members 52 which extend from flanges 50 on the end of connecting section 48 which in turn extends to the adjacent plate member 42. The contact spring members 52 are designed to receive a tablike terminal between their opposed surfaces and alternatively, to receive a tab in slots 54 which extend inwardly from the ends of these spring members. The terminals may be secured in the cavities by any suitable means, for example, by simply providing an interference fit of each terminal in its cavity, or alternatively, by providing suitable retaining lance means.

Prior to folding of the modules 18, 18' against each other, the wires 14 are connected to the terminals by simply aligning a wire with each of the terminals and moving the wires laterally into the wire receiving slots of the terminals. As will be discussed below, this operation can be carried out by anyone of a variety of known machines or tools.

After the wires have been connected to the terminals, cover member 56, 56' are assembled to the modules. These cover members are generally channel-shaped and comprise a web 58 and flanges 60. As will be apparent from the drawing, the cover members are dimensioned to fit relatively snugly over the modules with the web portions 58 against the module side-walls 30. The cover members thus close off the open upper ends, as viewed in the drawing, of the cavities. The cover members are retained on the modules by latching means, such as suitable latching ears 62 on the external surfaces of the endwall portions and openings or recesses 64 in the internal surfaces of the flanges 60, these recesses providing shoulders for engaging with the ears 62, as illustrated in FIG. 4. Additionally, ears 66 extend from the cavity walls and are received in complementary openings 68 in the web portions of the covers. These ears and openings further stabilize the cover members on the modules.

After assembly of the cover members to the modules, the modules are folded, as previously described, against each other until the latch arm 34 of the module 18' engages the shoulder 36 of the module 18. The connector will then be in its fully assembled form, as shown in FIGS. 3 and 4.

The cover members 56, 56' of the disclosed embodiment have spaced-apart projections 70 on the internal surfaces of their web portions, these projections being contoured to enter the wire receiving slots in the terminals and to engage the wire after the wire has been fully inserted and retain it in the wire receiving slot of the terminal. If desired, these projections can serve to push the wires into the slots; that is, the wires can be located in the slots without being fully inserted and upon assembly of the cover members to the modules, the wires will be completely inserted into the wire receiving slots 46 by the projections 70.

The modules 18, 18' are produced in the form shown in FIG. 1, that is, in side-by-side relationship so that the terminals in the two modules are all arranged in a row. A pair of modules in this form can thus be processed in a machine of the above identified type, disclosed in U.S. Pat. No. 4,043,017. The wires may be inserted into the terminals by the insertion punches of the apparatus and, if desired, the modules can then be removed from the apparatus and the cover assembly and folding operations carried out manually. Alternatively, the cover assembly operations and folding operations can also be carried out in subsequent assembly and folding stations of a machine, thereby to render the entire process fully automatic.

A pair of modules, as shown in FIG. 1, can also be used in the manufacture of electrical harnesses, as described in the above identified U.S. Pat. No. 3,859,724. The modules would be located on the harness board at locations where a two row connector is required. The wires can then be laced over the harness board and positioned in alignment with terminals. As was explained in the above identified U.S. patent, the wires are then inserted by a portable tool while the connector is on the harness board and the modules are thereafter assembled to each other by folding and the cover members of the assembled to the modules.

A salient advantage of the invention is that recently developed manufacturing techniques for harness making and for the manufacture of harness subassemblies can now be practiced with modules, in accordance with the invention, to produce two row electrical connectors in the harness rather than only single row connectors. It will, of course, be obvious that connector modules, in accordance with the invention, can also be used in other manufacturing processes in which the wires are inserted with simple bench presses or hand tools.

I claim:

1. A pair of connector modules which, when assembled to each other, form a two row electrical connector of the type comprising an insulating housing having a mating face and wire entry face, said faces being oppositely directed, spaced-apart endwalls and spaced-apart sidewalls extending between said faces, a plurality of terminal receiving cavities extending through said housing from said wire entry face to said mating face and a contact terminal in each of said cavities, said cavities and said terminals being arranged in two parallel rows which extend between said endwalls, said cavities and terminals in each row being in alignment with said cavities and terminals in the other row, said connector modules being characterized in that:

each of said modules comprises a molded housing module having a continuous planar barrier wall portion and having endwall portions extending from said barrier wall portions at the ends thereof, a single row of side-by-side terminal receiving cavities between said sidewall portions and terminals in said cavities, and a sidewall spaced from said barrier wall portions, said modules being in side-by-side aligned relationship with said barrier wall portions in a common plane and with said endwall portions in parallel spaced-apart planes, flexible hinge means integral with, and extending between, adjacent side edges of said barrier wall portions, said hinge means permitting relative pivotal movement of said modules towards and against each other about an axis extending parallel to, and between said adjacent side edges, and interengaging means on said modules effective to latch said modules to each other when said barrier wall portions are against each other whereby, wires can be connected to said wire receiving portions of said terminal while said modules are in side-by-side relationship, and said modules can be thereafter be pivotally moved towards each other and latched to each other to form said two row connector, said barrier wall portions being against each other after pivotal movement of said modules towards each other and forming a barrier wall between said two rows.

2. A pair of connector modules as set forth in claim 1, said terminals having wire receiving portions which face away from said barrier wall portions whereby wires are connected to said terminals upon movement of said wires towards said barrier wall portions.

3. A pair of connector modules as set forth in claim 2 in which each of said modules has a plurality of cavity walls extending from said barrier wall portions beween said endwall portions, each adjacent pair of cavity walls defining one of said cavities, said cavities opening onto said module sidewall.

4. A pair of connector modules as set forth in claim 3 and a pair of channel-shaped cover members dimensioned to be fitted over said modules with the web portions of each cover member against its associated module sidewall and with the flange portion of each cover member against its associated module endwall portion.

5. A pair of connector modules and a pair of cover members as set forth in claim 4, said flange portions of said cover members and said endwall portions of said modules having second latching means thereon for latching said cover members to said modules.

6. A two row electrical connector of the type comprising an insulating housing having a mating face and a wire entry face, said faces being oppositely directed, spaced-apart endwalls and spaced-apart sidewalls extending between said faces, a plurality of terminal receiving cavities extending through said housing from said wire entry face to said mating face and a contact terminal in each of said cavities, said cavities and said terminals being arranged in two parallel rows which extend between said endwalls, said cavities and terminals in each row being in alignment with said cavities and terminals in the other row, said connector being characterized in that:

said connector comprises a pair of connector modules, each of said modules comprising a molded housing module having a continuous planar barrier wall portion and having endwall portions extending from said barrier wall portions at the ends thereof, a single row of side-by-side terminal receiving cavities between said sidewall portions and terminals in said cavities, and a sidewall spaced from said barrier wall portions, said modules being in abutting relationship with said barrier wall portions against each other and forming a barrier wall between said two rows of cavities, corresponding endwall portions of said modules being coplanar and forming said endwalls of said connector, said pair of modules being connected to each other by hinge means integral with corresponding edge portions of said barrier wall portions, said modules being folded against each other, and interengaging latching means on said modules serving to maintain said modules in assembled condition.

7. A two row electrical connector as set forth in claim 6, said interengaging latching means comprsing, on each module, a latch arm extending from one of said endwall portions and a latching shoulder on the other endwall portion, said latch arm of each module being in engagement with the shoulder of the other module.

8. A two row electrical connector as set forth in either of claims 6 or 7 having a pair of channel-shaped cover members assembled to said modules, said cover members each having a web portion and spaced-apart flange portions, said web portions being against said sidewalls of said modules and said flange portions being against said endwall portions, and interengaging latching means on said endwall portions of said modules and on said flanges serving to maintain said cover members in assembled relationship to said modules.

* * * * *